US006757963B2

(12) United States Patent
Meier et al.

(10) Patent No.: US 6,757,963 B2
(45) Date of Patent: Jul. 6, 2004

(54) METHOD OF JOINING COMPONENTS USING A SILVER-BASED COMPOSITION

(75) Inventors: Alan M. Meier, Alfred, NY (US); David R. Miller, Allegany, NY (US); Kevin R. Dickson, Alfred, NY (US); Roger S. Perkins, Allegany, NY (US); Michael M. Ramarge, Olean, NY (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/052,249

(22) Filed: Jan. 23, 2002

(65) Prior Publication Data

US 2003/0137393 A1 Jul. 24, 2003

(51) Int. Cl.[7] ..... H01C 17/00

(52) U.S. Cl. ..... 29/610.1; 29/25.41; 29/619; 29/851; 228/254; 336/200

(58) Field of Search ..... 29/25, 41, 25.42, 29/610.1, 611, 612, 614, 616, 619–621, 830, 831, 846, 851; 228/122.1, 245, 246, 248.1, 254; 336/200; 148/24

(56) References Cited

U.S. PATENT DOCUMENTS

| | | | | |
|---|---|---|---|---|
| 3,440,182 A | * | 4/1969 | Hoffman | 252/514 |
| 3,740,830 A | | 6/1973 | Campbell, Jr. et al. | 29/472.7 |
| 4,272,754 A | * | 6/1981 | Lou | 338/21 |
| 4,369,063 A | * | 1/1983 | McGowan, Jr. | 252/514 |
| 4,447,392 A | | 5/1984 | Mizuhara | 420/501 |
| 4,573,265 A | * | 3/1986 | Conaway et al. | 29/879 |
| 4,606,980 A | | 8/1986 | Mizuhara | 428/606 |
| 4,643,875 A | | 2/1987 | Mizuhara | 420/502 |
| 4,667,871 A | | 5/1987 | Mizuhara | 228/122 |
| 4,749,594 A | | 6/1988 | Malikowski et al. | 427/190 |
| 4,835,593 A | | 5/1989 | Arnold et al. | 357/71 |
| 4,851,955 A | | 7/1989 | Doone et al. | 361/117 |

(List continued on next page.)

FOREIGN PATENT DOCUMENTS

| | | | |
|---|---|---|---|
| EP | 0005312 A2 | 3/1979 | B23K/35/30 |
| EP | 0245697 A2 | 4/1987 | H01L/23/52 |
| EP | 0945414 A2 | 9/1999 | C04B/37/02 |
| EP | 0945414 A3 | 10/1999 | C04B/37/02 |
| JP | 5163075 A | 6/1993 | C04B/37/00 |
| JP | 7133167 A | 5/1995 | C04B/37/02 |
| JP | 2000178078 A | 6/2000 | C04B/37/00 |
| JP | 2000178079 A | 6/2000 | C04B/37/00 |
| WO | WO94/03305 | 2/1994 | B23K/35/30 |

OTHER PUBLICATIONS

International Search Report dated Apr. 25, 2003.

*Primary Examiner*—A. Dexter Tugbang
*Assistant Examiner*—Donghai D. Nguyen
(74) *Attorney, Agent, or Firm*—Fish & Richardson P.C.

(57) ABSTRACT

A surface of a first ceramic component is joined to a surface of a second ceramic component using a silver-based composition. The silver-based composition is a mixture of silver metal and a metal oxide and the metal in the metal oxide is a metal other than silver. The silver-based composition is applied to the surface of the first ceramic component and to the surface of the second ceramic component. The silver-based composition applied to the first ceramic component is contacted to the silver-based composition applied to the second ceramic component. The surfaces of the first and second ceramic components are heated to melt the applied silver-based compositions. The surfaces of the first and second ceramic components are cooled to form a bond between the first and second ceramic components.

15 Claims, 6 Drawing Sheets

U.S. PATENT DOCUMENTS 4,992,906 A 2/1991 Doone et al. ..... 361/117
5,003,689 A 4/1991 Doone et al. ..... 29/613
5,009,357 A 4/1991 Baker et al. ..... 228/122
5,159,748 A 11/1992 Doone et al. ..... 29/613
5,176,762 A 1/1993 Berczik ..... 148/407
5,218,508 A 6/1993 Doone ..... 361/127
5,273,832 A 12/1993 Mizuhara et al. ..... 428/621
5,288,351 A 2/1994 Hoang et al. ..... 156/89
5,301,861 A 4/1994 Mizuhara et al. ..... 228/121
5,429,656 A * 7/1995 Hauner et al. ..... 75/232
5,523,159 A 6/1996 Kapoor et al. ..... 428/408
5,547,121 A 8/1996 Kapoor et al. ..... 228/121
5,567,525 A 10/1996 Kapoor et al. ..... 428/408
5,680,289 A * 10/1997 Robinson et al. ..... 338/21
5,720,859 A * 2/1998 Czubarow et al. ..... 427/553
5,896,264 A 4/1999 Bijlenga et al. ..... 361/106
6,008,977 A 12/1999 Thatcher ..... 361/127
6,037,068 A * 3/2000 de Rochemont et al. ... 428/689
6,396,676 B1 5/2002 Doone et al. ..... 361/117

* cited by examiner

METHOD OF JOINING COMPONENTS USING A SILVER-BASED COMPOSITION

TECHNICAL FIELD

This application relates to a method of joining materials that may be used in surge arresters and other types of electrical power distribution equipment.

BACKGROUND

Electrical transmission and distribution equipment is subject to voltages within a fairly narrow range under normal operating conditions. However, system disturbances, such as lightning strikes and switching surges, may produce momentary or extended voltage levels that greatly exceed the levels experienced by the equipment during normal operating conditions. These voltage variations often are referred to as over-voltage conditions.

If not protected from over-voltage conditions, critical and expensive equipment, such as transformers, switching devices, computer equipment, and electrical machinery, may be damaged or destroyed by over-voltage conditions and associated current surges. Accordingly, it is routine practice for system designers to use surge arresters to protect system components from dangerous over-voltage conditions.

A surge arrester is a protective device that is commonly connected in parallel with a comparatively expensive piece of electrical equipment to shunt or divert over-voltage-induced current surges safely around the equipment, thereby protecting the equipment and its internal circuitry from damage. When exposed to an over-voltage condition, the surge arrester operates in a low impedance mode that provides a current path to electrical ground having a relatively low impedance. The surge arrester otherwise operates in a high impedance mode that provides a current path to ground having a relatively high impedance. The impedance of the current path is substantially lower than the impedance of the equipment being protected by the surge arrester when the surge arrester is operating in the low-impedance mode, and is otherwise substantially higher than the impedance of the protected equipment.

When the over-voltage condition has passed, the surge arrester returns to operation in the high impedance mode. This high impedance mode prevents normal current at the system frequency from flowing through the surge arrester to ground.

Conventional surge arresters typically include an elongated outer enclosure or housing made of an electrically insulating material, a pair of electrical terminals at opposite ends of the enclosure for connecting the arrester between a line-potential conductor and electrical ground, and an array of other electrical components that form a series electrical path between the terminals. These components typically include a stack of voltage-dependent, nonlinear resistive elements, referred to as varistors. A varistor is characterized by having a relatively high impedance when exposed to a normal system frequency voltage, and a much lower resistance when exposed to a larger voltage, such as is associated with over-voltage conditions. In addition to varistors, a surge arrester also may include one or more spark gap assemblies electrically connected in series or parallel with one or more of the varistors. Some arresters also include electrically conductive spacer elements coaxially aligned with the varistors and gap assemblies.

For proper arrester operation, contact must be maintained between the components of the stack. To accomplish this, it is known to apply an axial load to the components of the stack. Good axial contact is important to ensure a relatively low contact resistance between the adjacent faces of the components, to ensure a relatively uniform current distribution through the components, and to provide good heat transfer between the components and the end terminals.

One way to apply this load is to employ springs within the housing to assure the stacked components engage with one another. Another way to apply the load is to wrap the stack of arrester components with glass fibers to axially-compress the components within the stack.

SUMMARY

In one general aspect, a surface of a first ceramic component is joined to a surface of a second ceramic component using a silver-based composition. The silver-based composition is a mixture of silver metal and a metal oxide and the metal in the metal oxide is a metal other than silver. The silver-based composition is applied to the surface of the first ceramic component and to the surface of the second ceramic component. The silver-based composition applied to the first ceramic component is contacted to the silver-based composition applied to the second ceramic component. The surfaces of the first and second ceramic components are heated to melt the applied silver-based compositions. The surfaces of the first and second ceramic components are cooled to form a bond between the first and second ceramic components.

Implementations may include one or more of the following features. The first ceramic component may include a varistor or, more particularly, a metal oxide varistor. The second ceramic component may include a varistor or, more particularly, a metal oxide varistor.

The silver-based composition is applied to the surface of the first ceramic component by preparing a powder of the metal oxide and then mixing the prepared metal oxide powder to form a metal oxide paste. A foil of silver metal is applied to the surface of the first ceramic component and the metal oxide paste is spread onto the applied silver foil to obtain the silver-based composition.

The silver-based composition may melt at a temperature less than melting points of the first and second ceramic components. In particular, the silver-based composition may melt between around 900° Celsius and 1000° Celsius.

The silver-based composition may be a mixture of silver metal and vanadium oxide. In this case, the mixture may include between around 0.1 to around 10% vanadium oxide by weight.

The first and second ceramic components may be compressed together before heating the surfaces of the ceramic components.

Application of the silver-based composition to the surface of the first ceramic component may include preparing the metal oxide and the silver metal, mixing the prepared metal oxide and the prepared silver metal to form a silver-based composition paste, and then spreading the silver-based composition paste on the first ceramic component to obtain the silver-based composition.

In another general aspect, a surface of a first ceramic component is joined to a surface of a second ceramic component using a silver-based composition. The silver-based composition is a mixture of silver metal and a metal oxide and the metal in the metal oxide is a metal other than silver. The silver-based composition is applied to the surface of the first ceramic component. The silver-based composition applied to the first ceramic component is contacted to the surface of the second ceramic component. The surfaces of the first and second ceramic components are heated to melt the applied silver-based composition. The surfaces of the first and second ceramic components are cooled to form a bond between the first and second ceramic components.

In another general aspect, a bonded component stack for use in surge arrester includes a first ceramic component having a surface, a second ceramic component having a surface, and a silver-based composition. The silver-based composition is a mixture of silver metal and a metal oxide and the metal in the metal oxide is a metal other than silver. The silver-based composition is brazed to the surfaces of the first and second ceramic components to bond the surface of the first ceramic component to the surface of the second ceramic component.

Implementations may include one or more of the following features. The first ceramic component may include a varistor or, more particularly, a metal oxide varistor. The second ceramic component may include a varistor or, more particularly, a metal oxide varistor.

The silver-based composition may be brazed between the surfaces of the first and second ceramic components by applying the silver-based composition to the surface of the first ceramic component; contacting the silver-based composition applied to the first ceramic component to the surface of the second ceramic component; heating the surfaces of the first and second ceramic components to melt the applied silver-based composition; and cooling the surfaces of the first and second ceramic components to form a bond between the first and second ceramic components.

The silver-based composition may be brazed between the surfaces of the first and second ceramic components by compressing the first and second ceramic components together before heating the surfaces of the ceramic components.

The silver-based composition may be brazed between the surfaces of the first and second ceramic components by applying the silver-based composition to the surface of the first ceramic component and to the surface of the second ceramic component; contacting the silver-based composition applied to the first ceramic component to the silver-based composition applied to the second ceramic component; heating the surfaces of the first and second ceramic components to melt the applied silver-based compositions; and cooling the surfaces of the first and second ceramic components to form a bond between the first and second ceramic components.

The silver-based composition may melt at a temperature less than melting points of the first and second ceramic components. The silver-based composition may melt between around 900° Celsius and 1000° Celsius.

The silver-based composition may be a mixture of silver metal and vanadium oxide. In that case, the mixture may include between around 0.1 to around 10% vanadium oxide by weight.

The bonded component stack and the method of making the bonded component stack provides the following advantages. The surfaces may be joined in an air atmosphere, which reduces production and manufacturing costs. The surfaces joined without the use of aggressive fluxes or a secondary heat treatment. The resulting bonded component stack has a relatively low contact resistance between the adjacent faces of the components, a relatively uniform current distribution through the components, and good heat transfer between the components. For these reasons, the need for additional mechanical reinforcement, such as axially-loaded springs, is eliminated.

Additionally, the method of joining eliminates the need for a metallized layer on the surface of the ceramic components because the silver-based composition is bonded directly to the surface. The method of joining also may be used without the need for additional heat treatment steps to recover varistor properties, which otherwise may be lost during the joining process.

Other features and advantages will be apparent from the description, the drawings, and the claims.

DESCRIPTION OF THE DRAWINGS

Like reference symbols in the various drawings indicate like elements.

DETAILED DESCRIPTION

Figure 1:
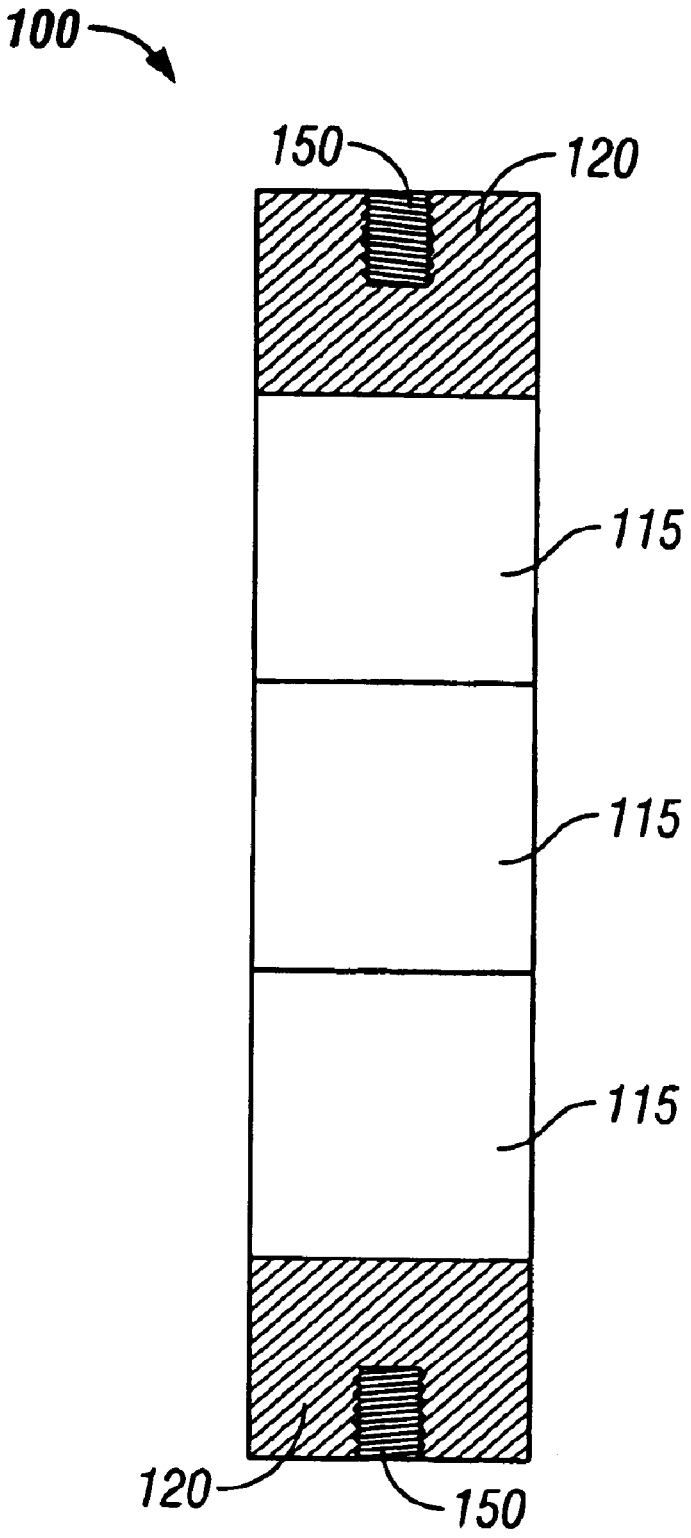
FIG. 1 is a cross-sectional view of an electrical component module.
Figure 2:
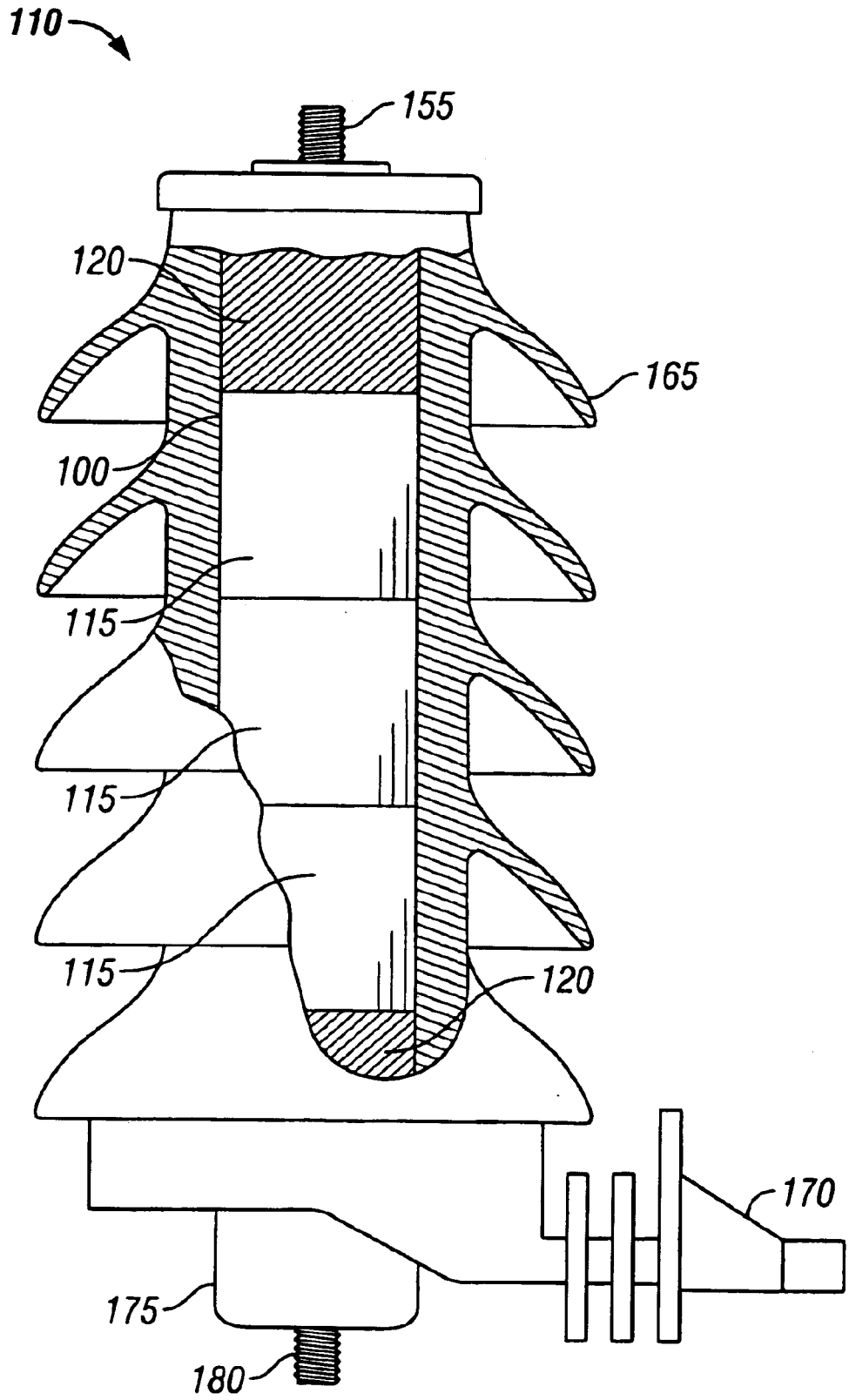
FIG. 2 is a partial cross-sectional view of a surge arrester employing the module of FIG. 1.

Referring to FIGS. 1 and 2, an electrical component module includes a bonded component stack 100 that serves as both the electrically-active component and the mechanical support component of a surge arrester 110. The stack 100 also exhibits high surge durability, in that it can withstand high current, short duration conditions, or other required impulse duties. For example, an implementation of the stack for use in heavy duty distribution arresters has proven capable of withstanding 100 kA pulses having durations of 4/10 microseconds, where 4/10 indicates that a pulse takes 4 microseconds to reach 90% of its peak value and 10 microseconds more to get back down to 50% of its peak value.

Components of the bonded component stack 100 are stacked in an end-to-end relationship and bonded together at their end surfaces. Since the components of the stack 100 are affirmatively bound together, the arrester 110 does not need to include a mechanism or structure for applying an axial load to the components.

The surge arrester 110 may be implemented as a distribution class surge arrester, such as a 10 kA heavy duty 10 kV (8.4 kV Maximum Continuous Operating Voltage) arrester. It should be understood, however, that the stack 100 may be used in other types of surge arresters, and in other electrical protective equipment.

The bonded component stack 100 may include different numbers of components, and components of different sizes or types. Examples of components include varistors, capacitors, thyristors, thermistors, resistors, terminals, spacers, and gap assemblies. For purposes of explanation, the stack is shown as including three metal oxide varistors (MOVs) 115 and a pair of terminals 120.

Figure 3:
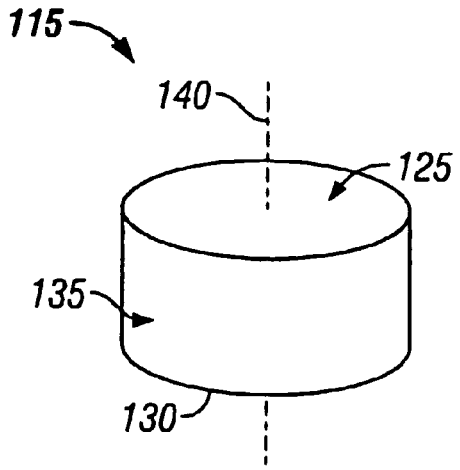
FIG. 3 is a perspective view of a ceramic component of the module of FIG. 1.

Referring also to FIG. 3, a ceramic component such as a MOV 115 is made of a metal oxide ceramic formed into a short cylindrical disk having a first surface 125, a second surface 130 opposite the first surface, and an outer cylindrical portion 135. The MOV 115 has a longitudinal axis 140. The metal oxide used in the MOV 115 maybe of the same material used for any high energy, high voltage MOV, such as a formulation of zinc oxide.

The MOV may be sized according to the desired application. For example, in one set of implementations, the MOV may have a diameter between approximately 1 to 3 inches, such that the surfaces 125, 130 each have areas of between about 0.785 and 7.070 square inches.

Given a particular metal oxide formulation and a uniform or consistent microstructure throughout the MOV, the thickness of the MOV determines the operating voltage level of the MOV. In one implementation, each MOV is about 0.75 inches thick. In some implementations, this thickness may be increased substantially (for example, tripled).

It is desirable to minimize the cross-sectional areas of the MOVs to minimize the size, weight, and cost of the arrester. However, the durability and recoverability of the MOVs tend to be directly related to the sizes of the MOVs. In view of these competing considerations, MOVs having diameters of approximately 1.6 inches have been used.

A terminal 120 is disposed at each end of the stack 100. Each terminal 120 is a relatively short, cylindrical block formed from a conductive material, such as, for example, aluminum. Each terminal 120 has a diameter substantially equal to that of an MOV 115. In some implementations, each terminal may also include a threaded bore 150 in which may be positioned a threaded conductive stud 155.

In general, the terminals 120 may be thinner than terminals associated with modules that, for example, are wrapped with a structural layer to provide an axial load on the components of the module. This reduced thickness may result from changes in the geometry of the device, or simply because thicker metal is not needed for bonding with the structural layer.

As shown in FIG. 2, the surge arrester 110 includes the bonded component stack 100, a polymeric housing 165, and an arrester hanger 170. The stack 100 is disposed within the polymeric housing 165. An insulating or dielectric compound (not shown), such as room temperature vulcanized silicone, may be used to fill any voids between the stack 100 and the inner surface of the housing 165. A threaded conductive stud (not shown) is disposed in the bore 150 of each terminal 120. The upper stud extends through the housing 165 and includes threads for engaging a terminal assembly (not shown). The lower stud extends through an aperture (not shown) in hanger 170 for connection to a ground lead disconnector 175. A threaded stud 180 extends from the disconnector 175 to engage a ground lead terminal assembly (not shown). The housing 165 is sealed about the upper and lower ends of the stack 100.

Components of the bonded component stack 100 are bonded together at their end surfaces, such that the stack 100 serves as both the electrically-active structure and the mechanical support structure of an electrical protective device such as the surge arrester 110. Components such as MOVs, thyristors, or capacitors are ceramic components. Components such as terminals and spacers are non-ceramic components. Bonding between components must provide bonds that are both mechanically stable and electrically conductive.

Figure 4:
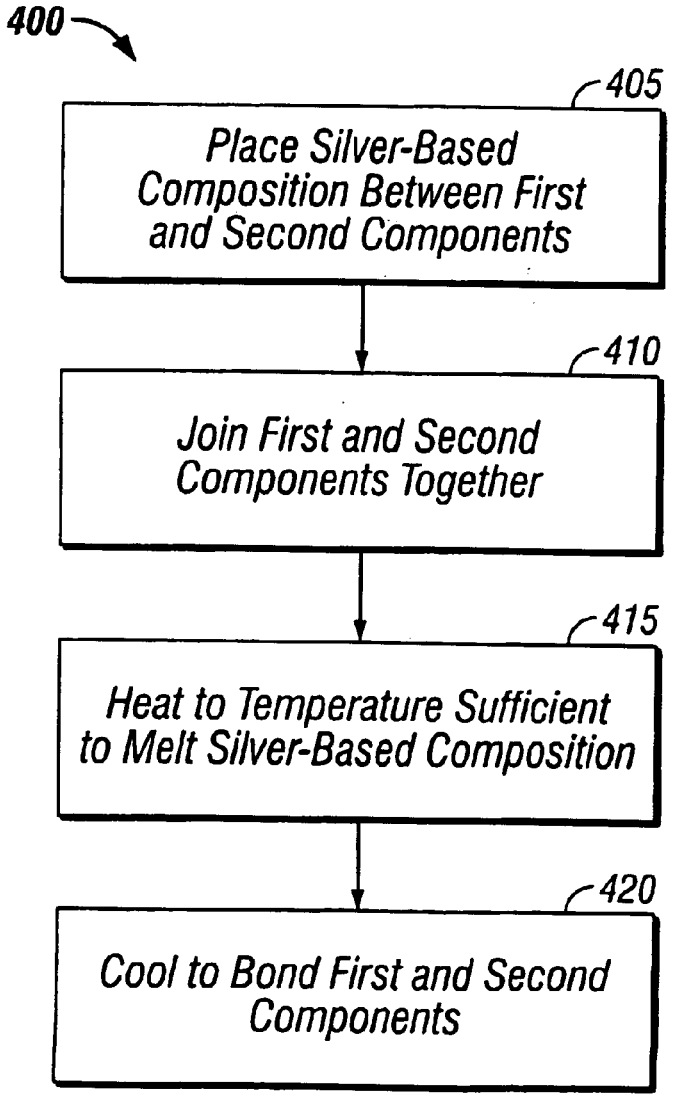
FIGS. 4, 6A, 6B, 8A, and 8B are flow charts of procedures for use in bonding components of an electrical component module.

Referring to FIG. 4, bonding between a surface on a first ceramic component (for example, an MOV 115) and the surface of second ceramic component (for example, a thyristor or another MOV) may be achieved according to a procedure 400. The procedure 400 may be performed in an air atmosphere.

Initially, a silver-based composition is placed between the first component and the second component (step 405). The silver-based composition is a mixture of silver metal and a metal oxide, in which the metal in the metal oxide is any suitable metal other than silver and the metal oxide is a low-melting-point oxide. A low-melting-point oxide is any oxide that has a melting point lower than the melting point of the first and second components between which it is placed. The general formula for the silver-based composition is Ag—$M_xO_y$, where Ag is silver metal, $M_xO_y$ is a low-melting-point metal oxide, and M is a metal selected from the group consisting of: vanadium, copper, zinc, indium, germanium, tin, lead, and magnesium. The ratio of the metal to oxygen (given by the ratio of x to y) depends upon the oxidation state of the metal in the metal oxide. In general, x and y are integers greater than zero. Particular examples of metal oxides include vanadium oxide ($V_2O_5$), magnesium oxide (MgO), and zinc oxide (ZnO).

In one implementation, the metal oxide is vanadium oxide ($V_2O_5$). Thus, the silver-based composition is a mixture of silver metal and vanadium oxide ($V_2O_5$), or silver-vanadium oxide (Ag—$V_2O_5$). Preferably, the silver-vanadium oxide has between approximately 0.1 to approximately 10% vanadium oxide by weight. Vanadium oxide is selected because the melting temperature of vanadium oxide is less than 1000° C., which is the melting temperature of zinc oxide, a common material used in metal oxide varistors.

The amount of silver-based composition placed between the first and second components will depend on the requirements for the type and/or strength of the resulting bond. At a minimum, the silver-based composition, once applied, should cover the entire surfaces of the first and second components. The amount of silver-based composition placed between the first and second components will be limited by, for example, the manufacturing cost and the mechanical integrity of the resulting bond. Thus, any suitable thickness may be contemplated, as long as the silver-based composition covers the entire surfaces of the first and second components, the manufacturing cost is reasonable, and the amount of silver-based composition does not adversely affect the mechanical integrity.

After the silver-based composition is placed between the first and second components (step 405), the first and second components are joined together (step 410). To join the first and second components together, pressure may be applied to the components along the longitudinal axis. For example, the applied pressure may range from approximately 25 to approximately 100 pounds per square inch.

Once the first component is joined with the second component (step 410), the joined components are heated to a temperature sufficient to melt the silver-based composition, a process that may be referred to as brazing (step 415). In one implementation, the brazing process may be performed in an air atmosphere or a near-air atmosphere.

The temperature to which the joined components are heated must be less than the melting point of the joined components. Additionally, the temperature to which the joined components are heated must be less than a temperature that results in a degradation of electrical and mechanical properties of the joined components. In one implementation, if the components to be joined are zinc oxide varistors, then the joined components may be heated to a temperature ranging from approximately 960° C. to approximately 1000° C., above which the electrical and mechanical properties of the zinc oxide begin to degrade. The heat may be applied to the joined components (step 415) for any suitable hold time. Because the mechanical properties of the bond may depend upon the hold time, it is appropriate to select a hold time depending on the requirements for the type and/or strength of the bond. In one implementation, the hold time may vary within the range of approximately zero to approximately ten minutes. In other implementations, longer hold times might be suitable.

After the hold time has elapsed, the first and second components are cooled to bond the first and second components together into a bonded component stack (step 420).

Figure 5A:
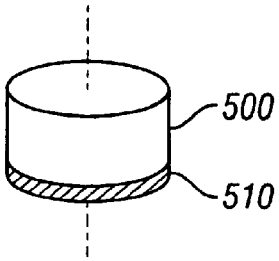
FIGS. 5A and 5B are perspective views of steps in preparing the ceramic components to be bonded according to the procedure of FIG. 4.
Figure 5B:
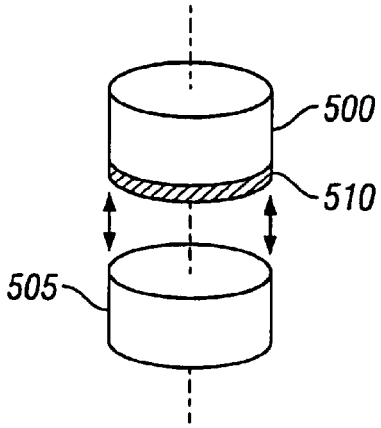
Figure 5C:
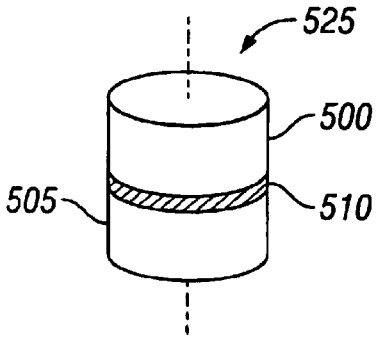
FIG. 5C is a perspective view of a bonded component stack formed according to the procedure of FIG. 4.
Figure 6A:
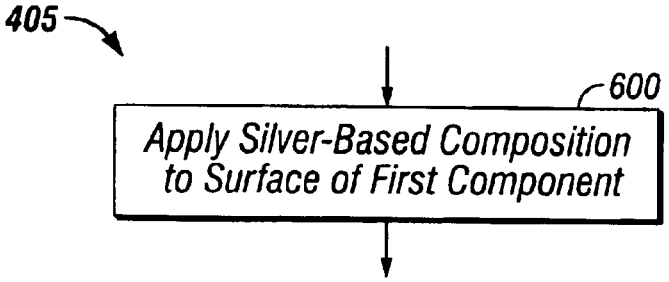
Figure 6B:
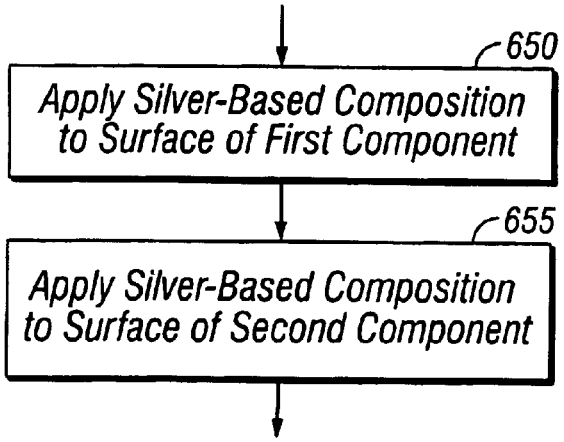

Referring also to FIGS. 5A, 5B, and 6A, in one implementation, the procedure 405 for placing a silver-based composition 510 between first and second components 500 and 505 includes applying the silver-based composition 510 to a second surface of the first component 500 using any suitable techniques (step 600). Then, the first and second components 500 and 505 are joined together (step 410) as shown in FIGS. 5B and 5C.

Figure 7A:
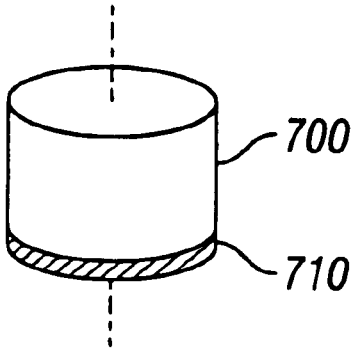
FIGS. 7A–7C are perspective views of steps in preparing the ceramic components to be bonded according to the procedure of FIG. 4.
Figure 7B:
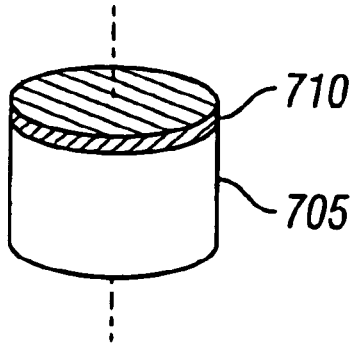
Figure 7C:
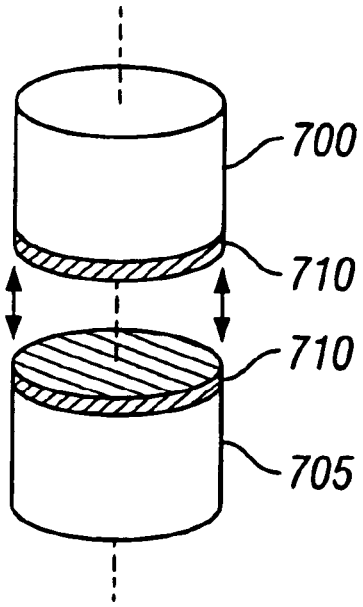
Figure 7D:
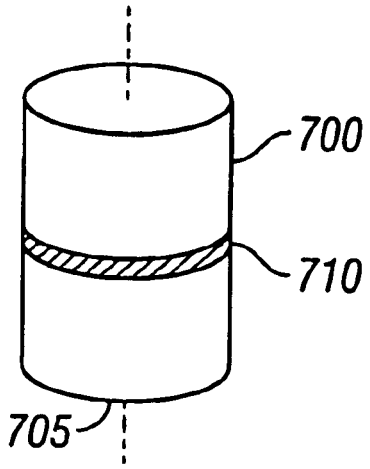
FIG. 7D is a perspective view of a bonded component stack formed according to the procedure of FIG. 4.

Referring also to FIGS. 7A–7C and 6B, in another implementation, the procedure 405 for placing a silver-based composition 710 between first and second components 700 and 705 includes applying the silver-based composition 510 to a second surface of the first component 700 (step 650) as shown in FIG. 7A. Additionally, the silver-based composition 510 is applied to a first surface of the second component 705 (step 655) as shown in FIG. 7B. The application of the silver-based composition 510 may be performed using any suitable technique. Then, the first and second components 700 and 705 are joined together (step 410) as shown in FIGS. 7C and 7D.

In a further implementation, the silver-based composition may be sandwiched between the first and second components using any suitable procedure.

Figure 8A:
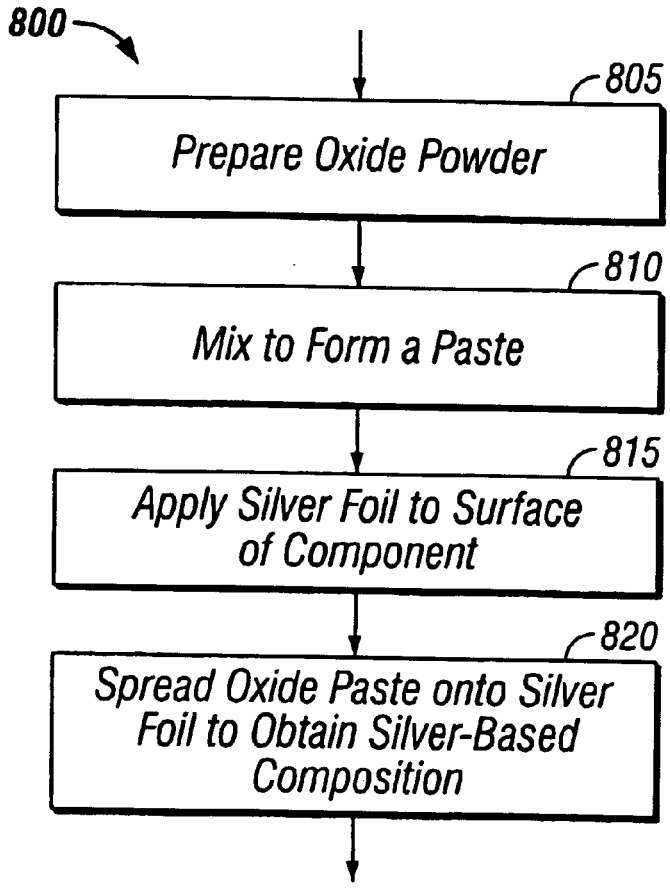

Referring to FIG. 8A, the silver-based composition may be applied (for example, as in step 600, step 650, or step 655) to a surface of a ceramic component according to a procedure 800. Initially, a metal oxide powder is prepared (step 805). The metal oxide powder is mixed to form a paste (step 810). In one implementation, mixing includes grinding the metal oxide powder in a blender. Then, a silver metal foil is applied to the surface of the ceramic component using any suitable technique (step 815). For example, the silver metal foil may be applied to the ceramic component by gluing the silver metal foil to the surface of the ceramic component using a suitable glue. The metal oxide paste then is spread on the applied silver metal foil to obtain the silver-based composition (step 820).

The amount of metal oxide paste spread on the silver metal foil and the thickness of the silver metal foil are interdependent parameters that may be varied. These parameters also may be varied depending on the target weight percentage of the metal oxide in the silver-based composition, the type of metal used in the metal oxide, and the surface area and/or size of the ceramic component to which the silver-based composition is applied. In any case, the parameters are varied to produce a stack having suitable mechanical and electrical properties.

Figure 8B:
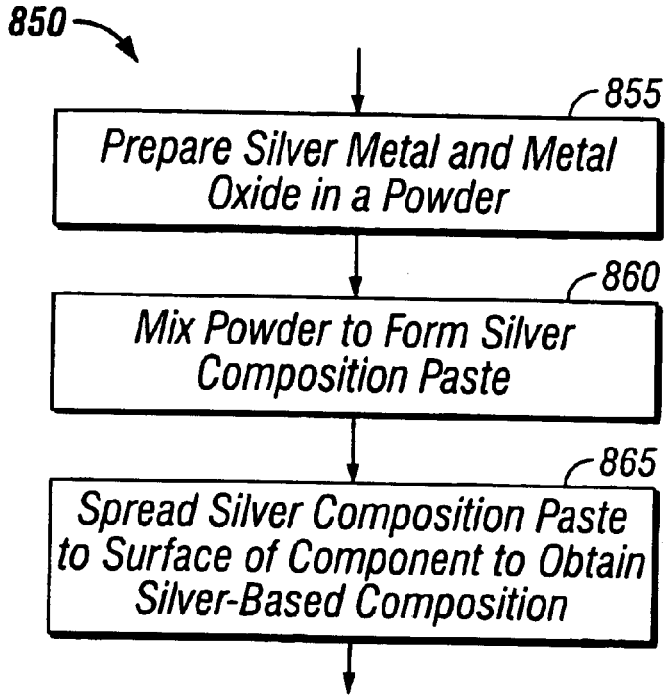

Referring to FIG. 8B, in another implementation, the silver-based composition maybe applied (for example, as in step 600, step 650, or step 655) to a surface of a ceramic component according to a procedure 850. Initially, the silver metal and the metal oxide are prepared as a powder (step 855). Then, the powder is mixed to form a paste of the silver-based composition (step 860), which is spread directly onto the surface of the ceramic to form the silver-based composition (step 865).

Other implementations are within the scope of the following claims. For example, in some implementations, an insulative coating may be bonded to the bonded component stack to form a component module, thus preventing the undesired entry of moisture or other contaminants to the surge arrester. The coating also may provide increased tensile and mechanical strength to the bonded component stack, as well as controlled venting of gases during a surge arrester failure. The insulative coating may cover the circumferential sides of the stack 100 and may be made thin enough to permit the stack to vent gas that may evolve during arrester component failure. In particular, when an MOV 115 or other internal component of the stack fails, pressure within the insulative coating would build as the internal arc burns adjacent materials. The pressure would increase until it reaches a magnitude that causes the insulative coating to burst, thus relieving the internal pressure and venting the evolved gas. An outer cylindrical surface of a terminal in the stack may be knurled, ribbed, or otherwise textured to improve adherence to the insulative coating.

Details regarding formulation of an insulative coating are described in U.S. Pat. No. 6,225,567, titled "Polymeric Weathershed Surge Arrester and Method" and issued May 1, 2001; and U.S. application Ser. No. 09/432,147, titled "Surge Arrester Module with Bonded Component Stack" and filed Nov. 2, 1999, which are incorporated by reference.

As noted above, the brazing technique using a silver-based composition may be applied between various ceramic components, including other types of varistors and thyristors.

What is claimed is:

1. A method of joining a surface of a first ceramic component to a surface of a second ceramic component, the method comprising:

applying a silver-based composition to the surface of the first ceramic component, the silver-based composition being a mixture of silver metal and a metal oxide, in which the metal in the metal oxide is a metal other than silver;

contacting the silver-based composition applied to the first ceramic component to the surface of the second ceramic component;

heating the surfaces of the first and second ceramic components to melt the applied silver-based composition; and cooling the surfaces of the first and second ceramic components to form a bond between the first and second ceramic components.

2. The method of claim 1 in which the first ceramic component comprises a varistor.

3. The method of claim 2 in which the second ceramic component comprises a varistor.

4. The method of claim 1 in which the first ceramic component comprises a metal oxide varistor.

5. The method of claim 4 in which the second ceramic component comprises a metal oxide varistor.

6. The method of claim 1 in which applying the silver-based composition to the surface of the first ceramic component includes:

preparing a powder of the metal oxide;

mixing the prepared metal oxide powder to form a metal oxide paste;

applying a foil of silver metal to the surface of the first ceramic component; and spreading the metal oxide paste onto the applied silver foil to obtain the silver-based composition.

7. The method of claim 1 in which the silver-based composition melts at a temperature less than melting points of the first and second ceramic components.

8. The method of claim 7 in which the silver-based composition melts between around 900° Celsius and 1000° Celsius.

9. The method of claim 1 in which the silver-based composition is a mixture of silver metal and vanadium oxide.

10. The method of claim 9 in which the mixture comprises between approximately 0.1 to approximately 10% vanadium oxide by weight.

11. The method of claim 1 further comprising compressing the first and second ceramic components together before heating the surfaces of the ceramic components.

12. The method of claim 1 in which applying the silver-based composition to the surface of the first ceramic component includes:

preparing the metal oxide and the silver metal;

mixing the prepared metal oxide and the prepared silver metal to form a silver-based composition paste; and spreading the silver-based composition paste on the first ceramic component to obtain the silver-based composition.

13. The method of claim 1 in which heating the surfaces of the first and second ceramic components comprises heating while in an air atmosphere or in a near air atmosphere.

14. The method of claim 1 in which contacting includes contacting the silver-based composition applied to the first ceramic component to a bare surface of the second component.

15. A method of joining a first ceramic component to a second ceramic component, the method comprising:

placing a silver-based composition between the first ceramic component and the second ceramic component, the silver-based composition being a mixture of silver metal and a metal oxide, in which the metal in the metal oxide is a metal other than silver;

joining the first ceramic component to the second ceramic component;

heating the first and second ceramic components to melt the silver-based composition; and cooling the first and second ceramic components to form a bond between the first and second ceramic components.

* * * * *